US005131798A

United States Patent [19]

Bell et al.

[11] Patent Number: 5,131,798

[45] Date of Patent: Jul. 21, 1992

[54] RAILROAD CAR CONVEYOR

[75] Inventors: James S. Bell, Brooklyn Park; Patrick J. Gallagher, Maple Grove, both of Minn.

[73] Assignee: Loram Maintenance of Way, Inc., Hamel, Minn.

[21] Appl. No.: 636,610

[22] Filed: Dec. 28, 1990

[51] Int. Cl.[5] ..... B60P 1/36

[52] U.S. Cl. ..... 414/339; 414/528; 414/353; 414/334; 414/501; 414/488; 198/316.1; 198/315; 198/367; 298/17.7; 105/269

[58] Field of Search ..... 414/334, 339, 351, 348, 414/353, 398, 527, 528, 473, 488, 501, 502, 503, 504, 505; 105/269, 261.1; 198/316.1, 315, 367; 298/17.5, 17.6, 17.7

[56] References Cited

U.S. PATENT DOCUMENTS 1,448,756 3/1923 MacEachen ..... 414/339
3,167,193 1/1965 Klosk ..... 414/339 X
3,355,041 11/1967 O'Leary .
4,783,171 11/1988 Zimmerman ..... 414/528 X
4,923,355 5/1990 Mancini ..... 414/353 X

FOREIGN PATENT DOCUMENTS 132197 9/1978 German Democratic Rep. ..... 414/334

*Primary Examiner*—Frank E. Werner
*Attorney, Agent, or Firm*—Merchant, Gould, Smith, Edell, Welter & Schmidt

[57] ABSTRACT

Material handling apparatus for conveying loose material into an elongated container such as a railroad car. An endless belt conveyor is mounted above and extends the full length of the container. A plurality of equally-spaced, individually, selectively operable discharge stations are disposed along the conveyor for discharging material off the sides of the conveyor into the elongated container, thereby providing for uniform loading of the car. Mechanism is provided for raising the conveyor above the container to permit pivotal side dumping of the container without engagement between the container and the conveyor.

16 Claims, 11 Drawing Sheets

| FIG. 2b |
| --- |
| FIG. 2a |

16
15
40
160
164
162
157
64
61
63
31
166
151
R
20
17
53
51
54
13
12
153
152
II

RAILROAD CAR CONVEYOR

BACKGROUND OF THE INVENTION

The invention is in the field of conveying large quantities of loose material, such as dirt, rocks or other granular material, into an elongated container, such as a railroad hopper car, for transport of the material to a dump site. The invention is particularly useful in railroad right-of-way maintenance, including cleaning-out ditches along the right-of-way and removing old ballast from beneath the rails and ties of a track.

In such applications, high volume and weights of material must be handled and temporarily stored in large containers, most typically a series of railroad hopper cars connected to form a train, and transported to a dump or discharge site. Because of the elongated nature of a railroad car, provision must be made for discharging the material into the car reasonably uniformly throughout the length of the car for maximum utilization of carrying capacity and provision must be made for efficient dumping of the car at the dump site. Other requirements peculiar to this field include addressing the need for unifoirm discharge from both sides of a conveyor belt into a railroad car, particularly when the car is on a super elevated curve in the track thereby resulting in tilting the conveyor and car toward the inside of the curve and creating a tendency for all material to be discharged from the lower side of the conveyor belt, thereby overloading the car on one side. An additional requirement is efficient dumping, which is best achieved by side dumping each car at the dump site. Side dumping alters the center of gravity of the loaded car during the dumping operation. Additional shifting of the center of gravity occurs if the conveyor structure is tipped to one side as the hopper is tipped for side dumping, which occurs if the conveyor structure is mounted directly to the hopper. The combined weight shift of the material, the railroad hopper structure and the conveyor structure causes unstable conditions and leads to tipping the car off the tracks, an obviously undesirable result, unless tie-down steps are taken.

Prior art apparatus has been constructed with the conveyor structure mounted directly to the side-dumping hopper. In the prior art the stability problem has been addressed by requiring tie down of the wheels of a car being side dumped on the side opposite the discharge side to prevent roll over. This is an unsatisfactory solution, however, because of the extra labor and tie-down apparatus required, and it is dependent on the ability to achieve a secure tie down, which is not always possible. The problem of non-uniform discharge from the respective sides of the conveyor belt when the conveyor is tilted when the railroad car is on a super elevated curve has not been addressed by any prior art apparatus known to applicants.

O'Leary U.S. Pat. No. 3,355,041 teaches a train-like series of hopper tubs and scraper means for loading consecutive tubs, but fails to address the problems described above.

SUMMARY OF THE INVENTION

The present invention is a material handling and transporting apparatus comprised of a wheel mounted main frame, an elongated container mounted on the main frame for pivotal side dumping with respect to the main frame, a conveyor frame mounted to the main frame above the container extending the length of the container, and an enedless belt on the conveyor frame. Means is provided for driving the endless belt. A plurality of individually, selectively operable means is provided along the length of the conveyor for deflecting material carried on the endless conveyor belt off the sides of the conveyor belt into the container below. Means in the form of telescopic corner posts mounted on the main frame is provided for raising the conveyor frame a sufficient distance above the container to allow pivotal, side dumping movement of the container without tilting or engaging the conveyor frame structure.

Structure characterized by a V-plow shaped deflector plate spaced above the conveyor belt at each of four discharge stations, and means for lifting the conveyor belt into close proximity with the V-plow deflector plate is provided to deflect material off the sides of the conveyor belt at the discharge stations. Means is also provided for selectively setting the effective width of the V-plow deflector plate to discharge material to one side or the other at the respective discharge stations, to provide for selectively discharging of material to one side of the conveyor belt only and to provide for balanced discharge from the respective conveyor belt sides when the apparatus is on a super elevated base, such as a curve on a railroad track, and the conveyor belt is tilted.

DESCRIPTION OF DRAWINGS

In FIG. 15 the posts are shown in their lowered or retracted position.

DESCRIPTION OF PREFERRED EMBODIMENT

General Construction and Operation of Major Components

Figures 1, 2:
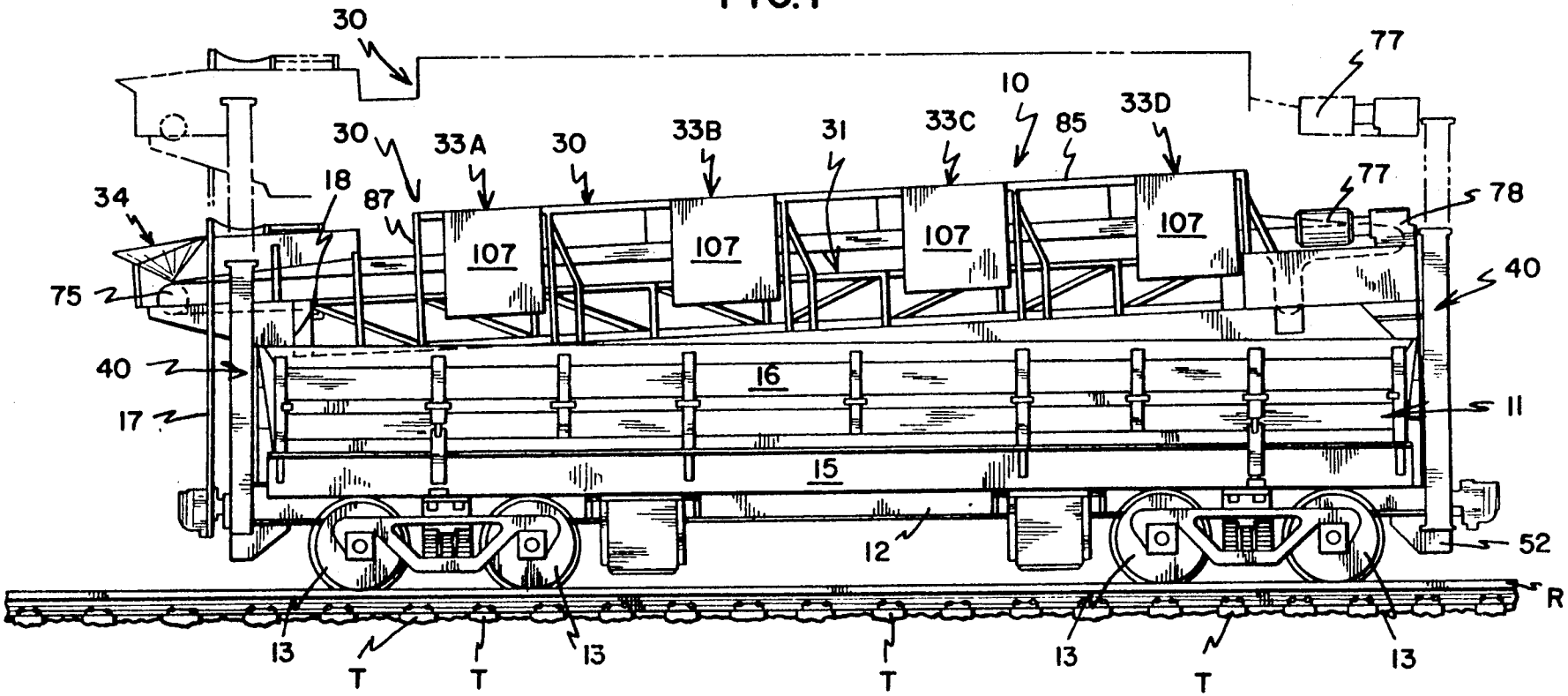
FIG. 1 is a side view which shows the main components of the invention.
FIG. 2 is a composite side view of the invention consisting of FIGS. 2*a* and 2*b*, and shows the main components of the invention, like FIG. 1, and additional details not shown in FIG. 1.
Figure 2A:
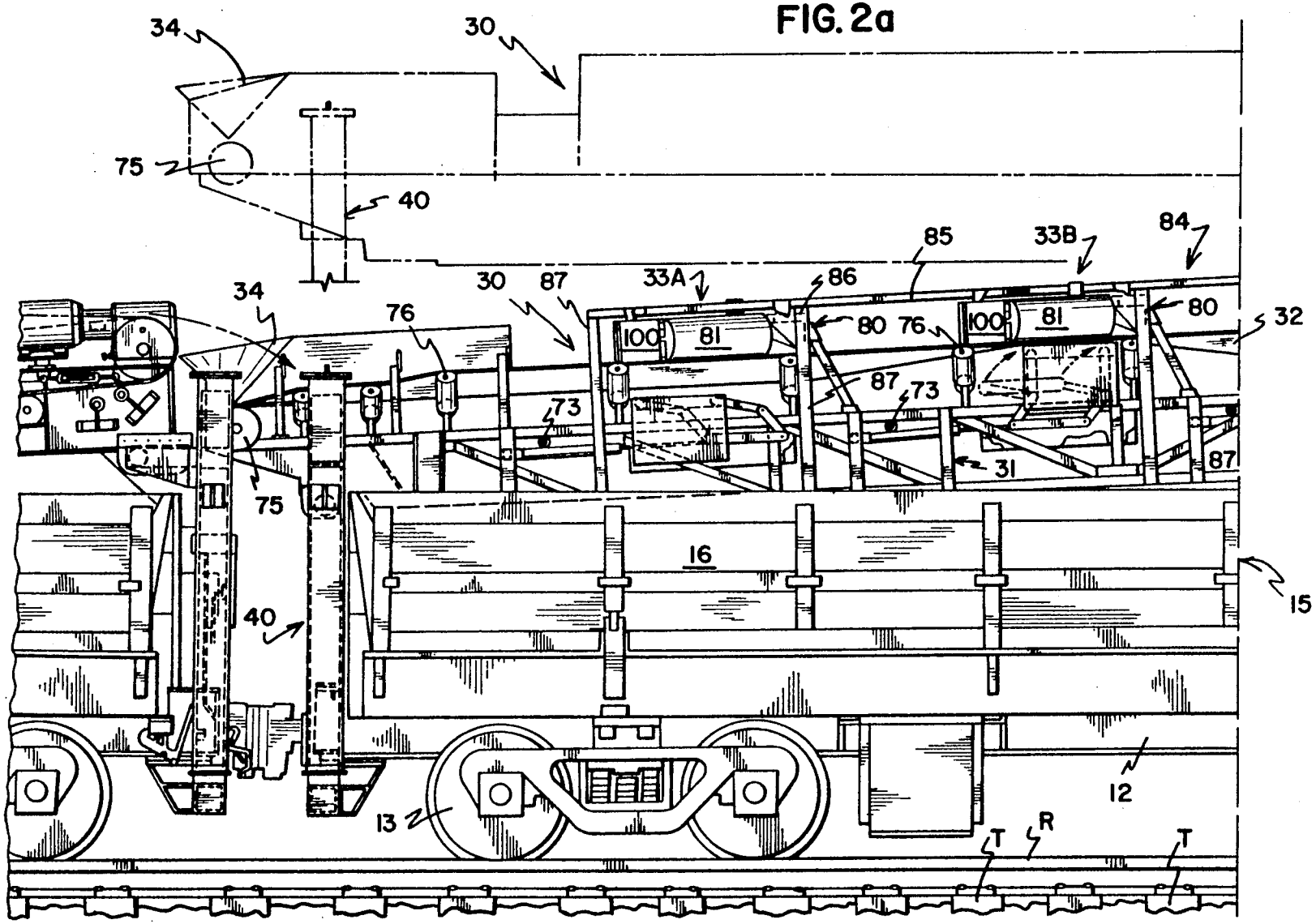
Figure 2B:
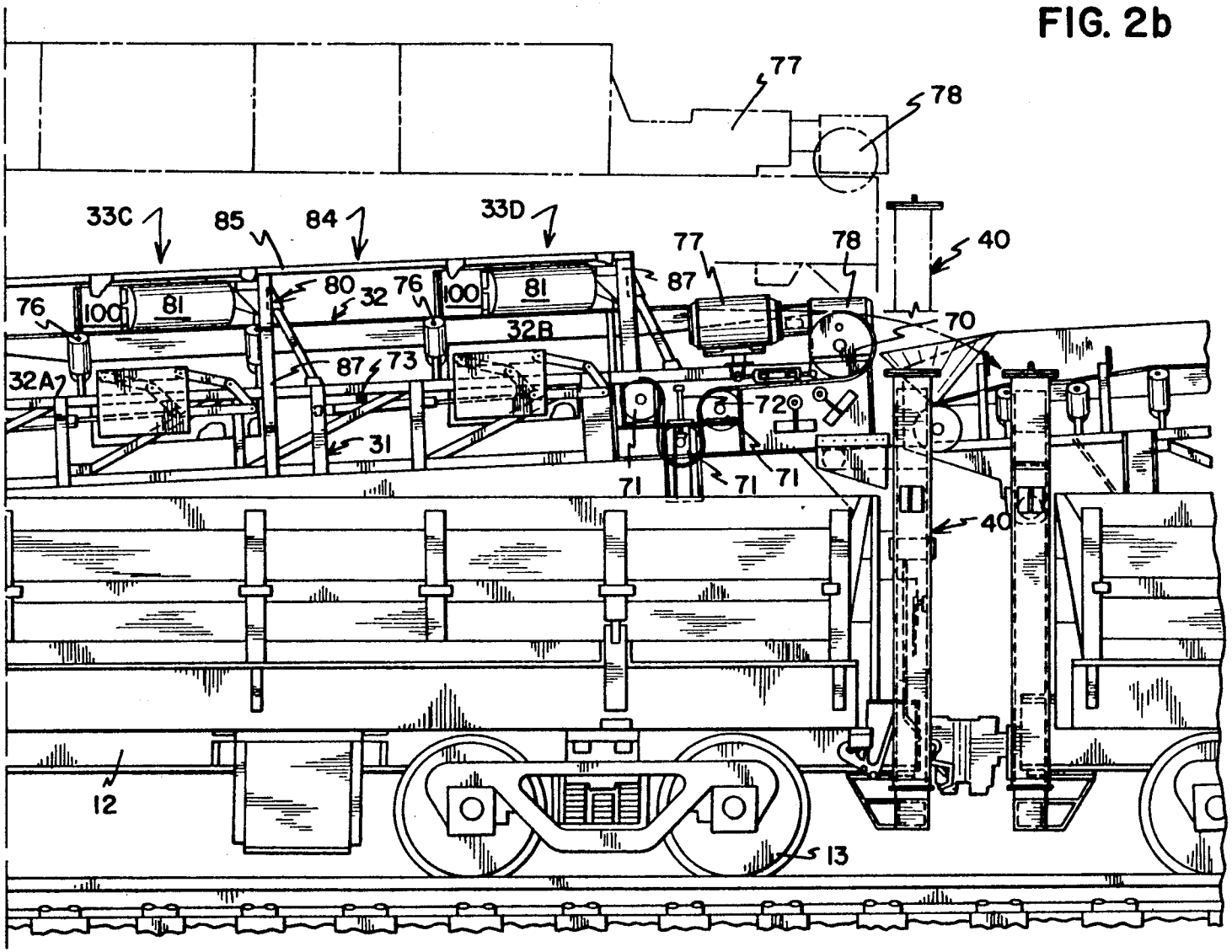

The general construction and operation of the major components of the preferred embodiment of the invention 10 may be understood with reference to FIGS. 1 and 2, in which a conventional side-dump or discharge railroad hopper car 11, including main frame 12, is mounted on wheels 13 for travel on rails, R, on ties, T. Railroad car 11 has a conventional side-dump, elongated hopper or caontainer 15 with side walls 16 pivotally mounted to main frame 12 for side dumping or discharge from either side. Car 11 includes ladder 17, platform 18, catwalk 19 and side rails 20.

Conveyor assembly 30 is mounted above container 15, extending the full length thereof and includes conveyor frame 31 mounted on telescopic conveyor corner mounting posts 40, which are mounted to main frame 12. Conveyor assembly 30 includes endless belt conveyor 32 and four discharge stations 33A, 33B, 33C and 33D.

In operation, material, M, from beneath or along side the rails, R, is picked up and discharged by means not shown into conveyor hopper 34 and flows onto the conveyor belt 32, the upper material conveying flight 32B of which travels from the left (upstream) to the right (downstream) as viewed in FIGS. 1 and 2. Material, M, is selectively deflected or discharged from the belt 32 at discharge stations 33 A–D as desired, and falls into container 15 below. When one container or hopper is filed, material can be conveyed the length of the filled car and discharged onto the conveyor of a connected car, as shown in FIG. 2, to fill the connected car. This procedure can be repeated for other connected cars.

Figure 14:
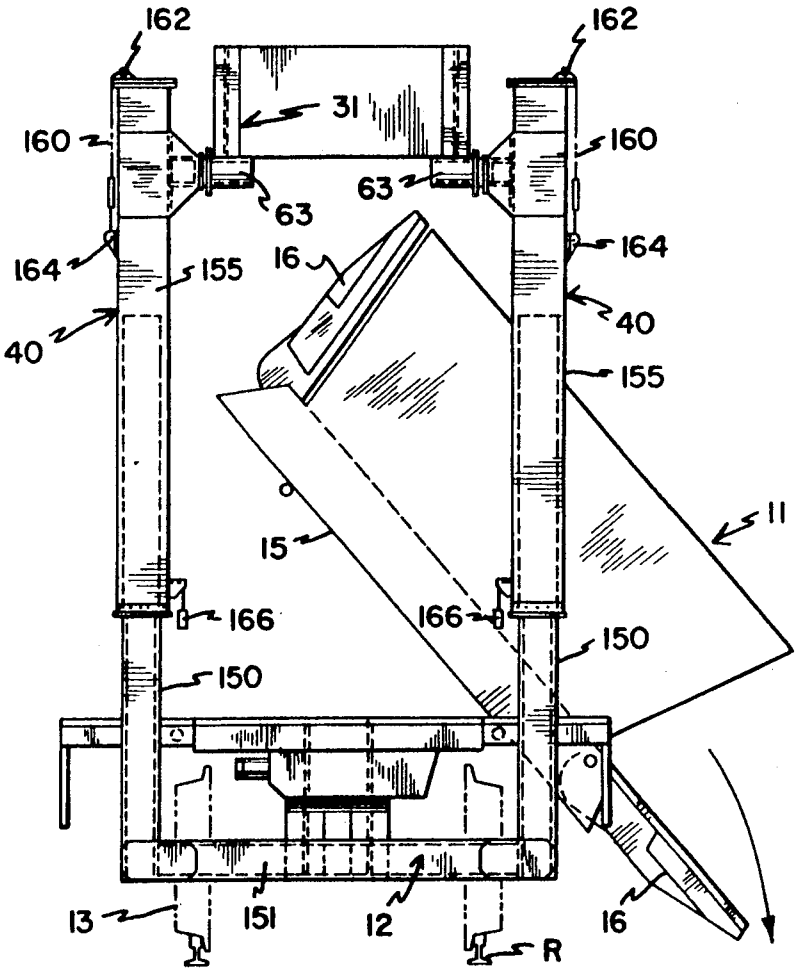
FIG. 14 is an end view of the downstream end of the invention with the conveyor frame and conveyor, like FIG. 13, in its raised or extended position, with the hopper or container in its side dump or discharge position.
Figure 13:
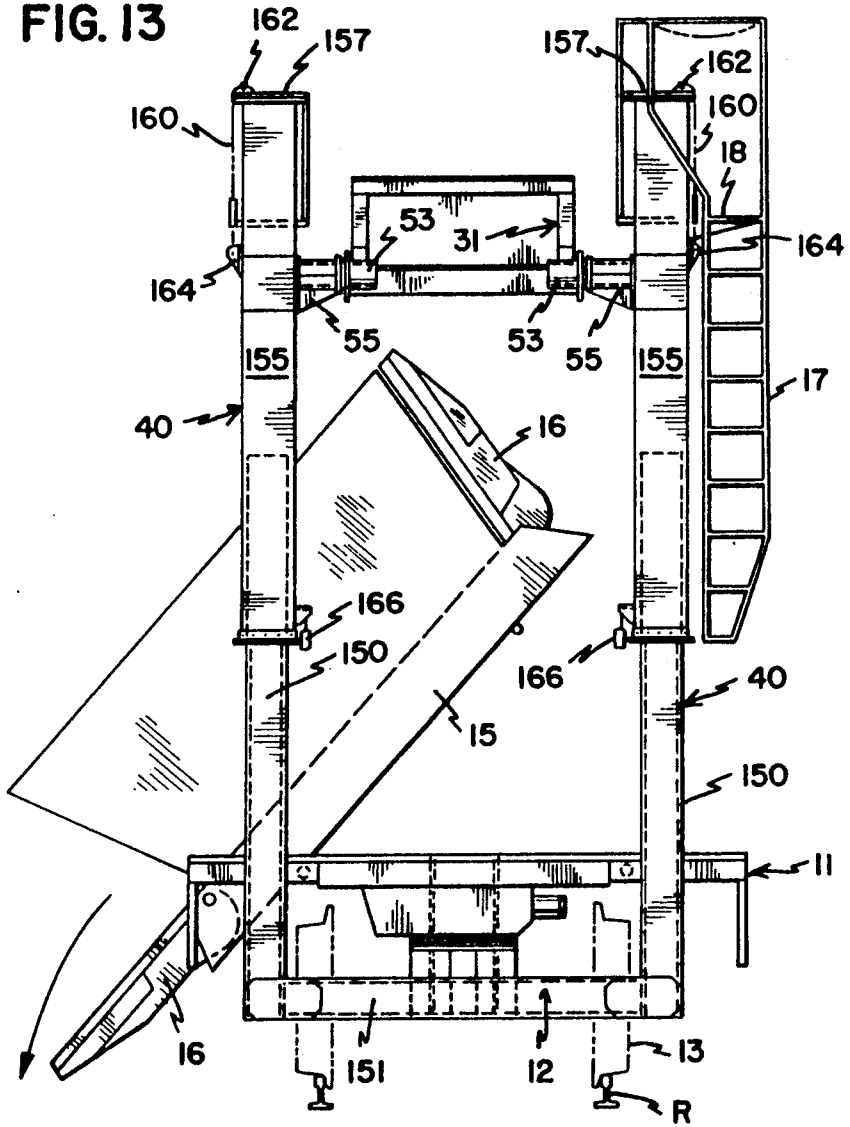
FIG. 13 is and end view of the upstream end of the invention with the conveyor frame and conveyor in its raised or extended position corresponding to the view shown in phantom in FIGS. 1 and 2, with the hopper or container shown in its side dump or discharge position.

When it is desired to dump material, M, from a car, conveyor assembly 30 is raised to the position shown in phantom in FIGS. 1 and 2 and shown in FIGS. 13 and 14, by extension of telescopic mounting posts 40, and the container is side dumped as shown in FIGS. 13 and 14. The side dumping procedure is accomplished without moving the conveyor assembly 30 out of its centerline position so that it does not contribute to shifting the center of gravity outside the rails thereby causing the car to tip over. Only the pivotal movement of the container and material, M, contributes to lateral shifting of the center of gravity, which is not sufficient to move the center of gravity outside the rails, and the car does not tip.

After the car is dumped, conveyor assembly 30 is lowered or retracted by retraction of posts 40 into the position shown in solid lines in FIGS. 1 and 2, and the loading and dumping procedure can be repeated.

Detailed Construction

The detailed construction of each of the major components of the invention referred to above is as follows.

Figure 7:
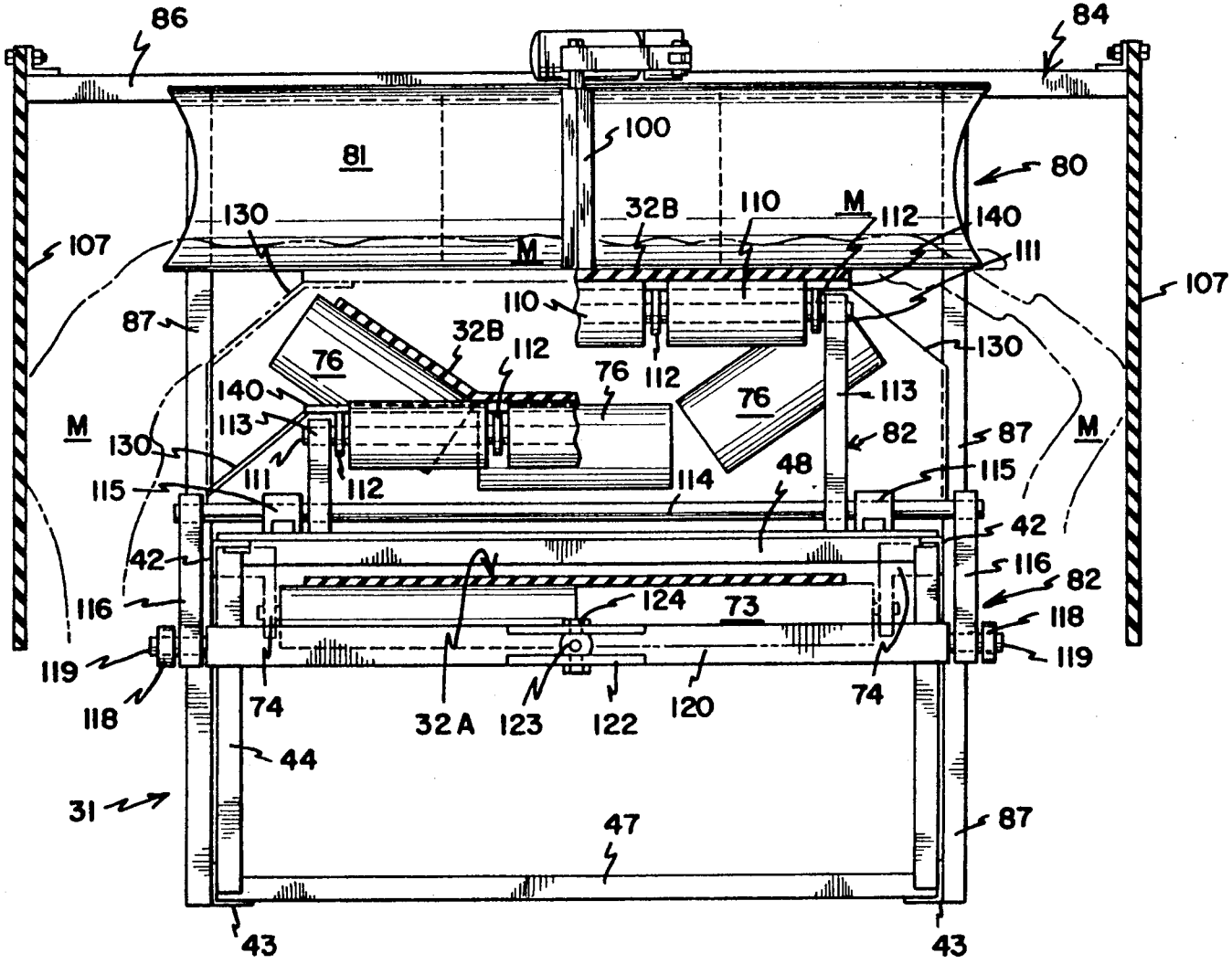
FIG. 7 is a vertical sectional view of the endless belt conveyor, the conveyor frame, th eV-plow deflector and means for lifting the conveyor belt into close proximity with the deflector to deflect material off the conveyor belt into the hopper or container, taken on the line 7—7 of FIG. 6.
Figure 8:
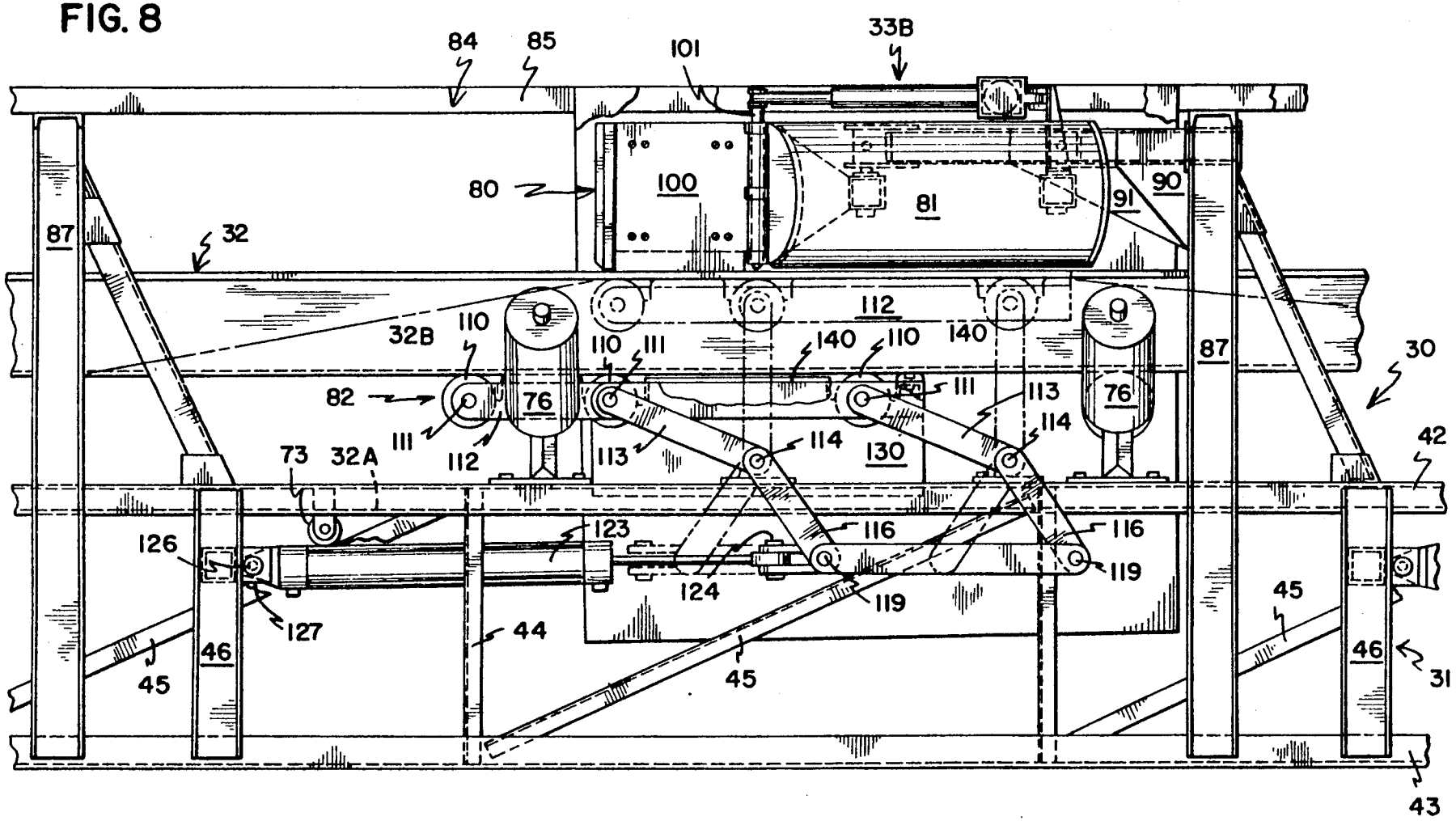
FIG. 8 is a side view of a discharge station taken on the line 8—8 of FIG. 3.

Conveyor assembly 30, best seen in FIGS. 2, 7 and 8, includes conveyor frame 31, endless belt conveyor 32 and four discharge stations 33A, 33B, 33C and 33D.

Conveyor frame 31 is formed of upper stringers 42, lower stringers 43, vertical cross members 44, diagonal stiffeners 45, vertical channel reinforcing members 46, transversely extending horizontal lower cross members 47 and upper cross members 48.

Figures 10, 11, 12:
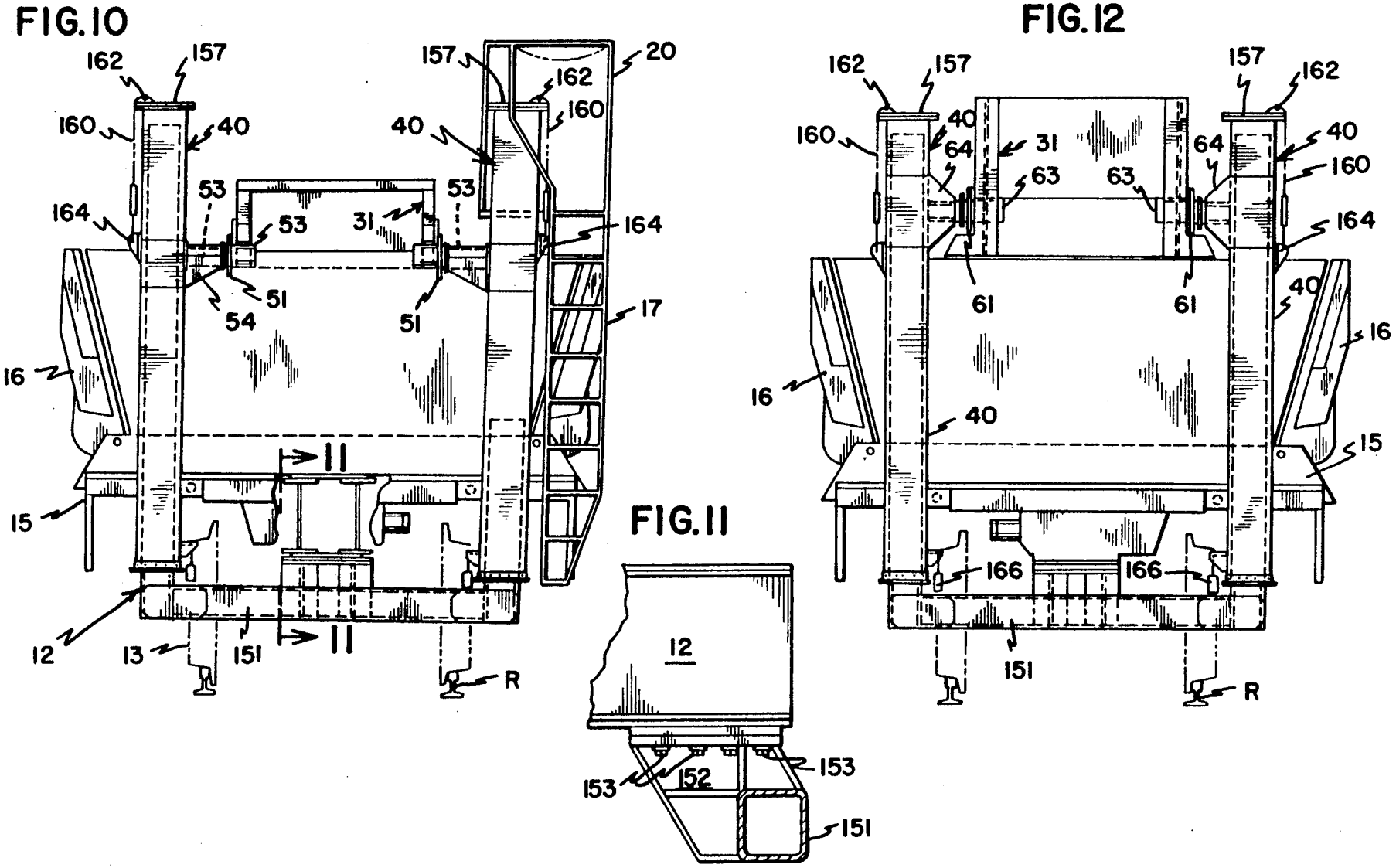
FIG. 10 is an end view showing the upstream end of the invention with the conveyor frame and conveyor in its lowered or retracted position in close proximity to the hopper or container.
FIG. 11 is a fragmentary sectional view of the main frame taken on the line 11—11 of FIG. 10.
FIG. 12 is an end view of the downstream end of the invention with the conveyor frame and conveyor, like FIG. 10, in its lowered or retracted position.

Conveyor frame 31 is mounted to telescopic posts 40 of mainframe 12 as best seen in FIGS. 2-5. At the left or upstream end of conveyor frame 31, shown in FIG. 4, upper stringer 42 of conveyor frame 31 is welded to spacer 50. Slotted plates 51 are mounted on each side of the conveyor frame 31 by bolts 52 which extend into spacer 50 and upper stringer 42. Studs 53 extend into slots 54 of plate 51. Studs 53, shown also in FIG. 10, are mounted to posts 40, extend inwardly, and are reinforced by gusset plates 55 welded to posts 40. The upstream end of conveyor frame 31 is thus mounted to upstream posts 40 for pivotal and horizontal sliding movement of conveyor frame 31 with respect to mainframe 12 as plate 51 pivots about the axis of and moves horizontally in slot 54 with respect to stud 53. This allows one end of conveyor frame 31 to be raised or lowered, independently of raising and lowering the other end.

Figure 3:
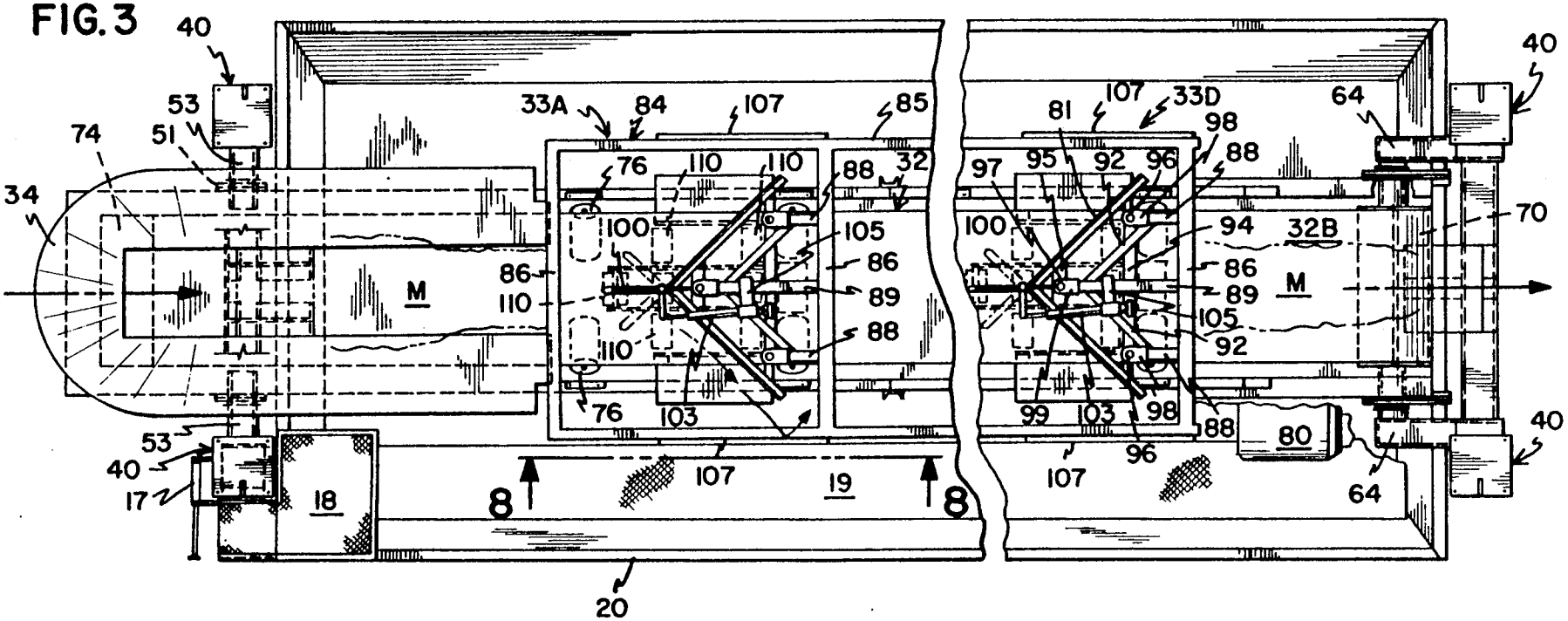
FIG. 3 is a top view of the conveyor assembly of the invention with a midportion cut away.
Figure 5:
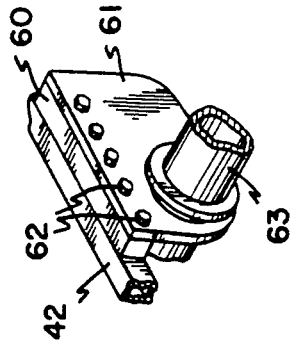
FIG. 5 is a perspective view, similar to FIG. 4, of the downstream end of the conveyor frame and shows the manner in which the downstream end of the conveyor frame is attached to the main frame for pivotal movement with respect thereto.
Figure 4:
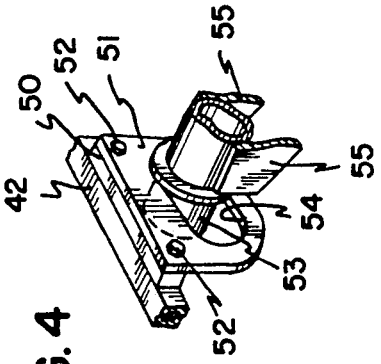
FIG. 4 is a perspective view of the upstream end of the conveyor frame of the invention and shows the manner in which the upstream end of the conveyor frame is attached to the main frame for both pivotal movement and longitudinal sliding movement with respect to the main frame.

The downstream end of conveyor frame 31, as best seen in FIGS. 3, 5 and 12, is pivotally mounted by spacer 60 welded to the downstream end of upper stringer 42, plate 61 and bolts 62 to studs 63, which extend inwardly from arms 64 mounted to downstream posts 40. Conveyor frame 31 is therefore mounted to downstream studs 63 for pivotal movement.

The upstream and downstream telescopic posts 40 can be extended and retracted, as described in more detail below, independently, to thereeby raise and lower conveyor frame 31 to elevate the conveyor assembly 30 above the container structure 15 to allow side dumping of the container 15 and to adjust the slope of the conveyor frame 31 and conveyor belt 32.

Conveyor belt 32, shown in FIGS. 2, 3, 7 and 8, is an endless belt that extends around drive roller 70, idler rollers 71, one of which is displaceable by adjusting bolts 72 to thereby adjust belt tension, and over a lower flight 32A, which runs from the downstream end of conveyor frame 31 to the upstream end, the full length of elongated container 15. The lower flight 32A is supported on spaced, idling support rollers 73. Support rollers 73 are journaled in brackets 74 (shown in FIG. 7) suspended from upper stringers 42 of conveyor frame 31. Conveyor belt 32 then passes over upstream-end main idler roller 75, shown in FIGS. 2 and 3, which is journaled for rotation on the upstream end of conveyor frame 31. After passing over roller 75, conveyor belt 32 begins its upper load-carrying flight 32B from the upstream end to the downstream end of conveyor frame 31. Along upper flight 32B conveyor belt 32 is supported by rollers 76 disposed to support the upper flight 32B of conveyor belt 32 in a trough as shown in FIG. 7. Material, M is carried in the trough of upper flight 32B.

Conveyor belt 32 is driven by a 30 horsepower electric motor 77, operating through a right angle 9 3/4:1 gear reduction unit 78 and conventional gearing to drive belt 32 at about 800 feet per minute. Material, M, is thus carried at that speed from the upstream end to the raised downstream end of the conveyor assembly 30, from the left to right as viewed in FIG. 2. With a 36" wide belt, about 400 cfm or 1200 tons of material per hour can be conveyed on belt 32.

Four discharge stations 33A, 33B, 33C and 33D are provided above upper flight 32B of conveyor belt 32 as shown generally in FIGS. 1 and 2 and in greater detail in FIGS. 3, 7 and 8. Each discharge station 33 includes a deflector plate assembly 80, characterized by V-plow 81, mounted above upper flight 32B of conveyor belt 32, and a belt lifting assembly 82 mounted beneath upper flight 32B and above lower flight 32A of conveyor belt 32.

Deflector plate assembly 80 is mounted a sufficient distance above upper flight 32B so that, in its normal trough position on rollers 76, material, M, lies in the trough of conveyor belt 32 and passes freely beneath deflector plate assembly 80 and is not deflected off of belt 32. The detailed construction and mounting of deflector plate assembly above conveyor belt 32B is shown in FIGS. 3, 6, 7 and 8. Deflector plate mounting rack 84 includes longitudinal members 85 and cross members 86 and is mounted above conveyor frame 31 and upper flight 32B of belt 32 on posts 87, which are welded to and extend upwardly from conveyor frame 31. V-plow 81 is cantilevered from cross member 86 of rack 84 on arms 88 and 89, which are reinforced by gusset plates 90 and 91, respectively, welded to cross member 86 and a lower cross member (not shown) below and parallel to cross member 86. Diagonals 92 extend from arms 88 to arm 89. Cross members 94 and 95 are welded across the rear of V-plow 81, from one blade to the other, and serve to make the V-plow deflector plate 81 rigid. Pins 96 and 97 mount the V-plow 81 to arms 88 and 89, passing through clevises 98 and 99 welded to arms 88 and 89, respectively, and cross members 94 and 95, respectively.

Figure 6:
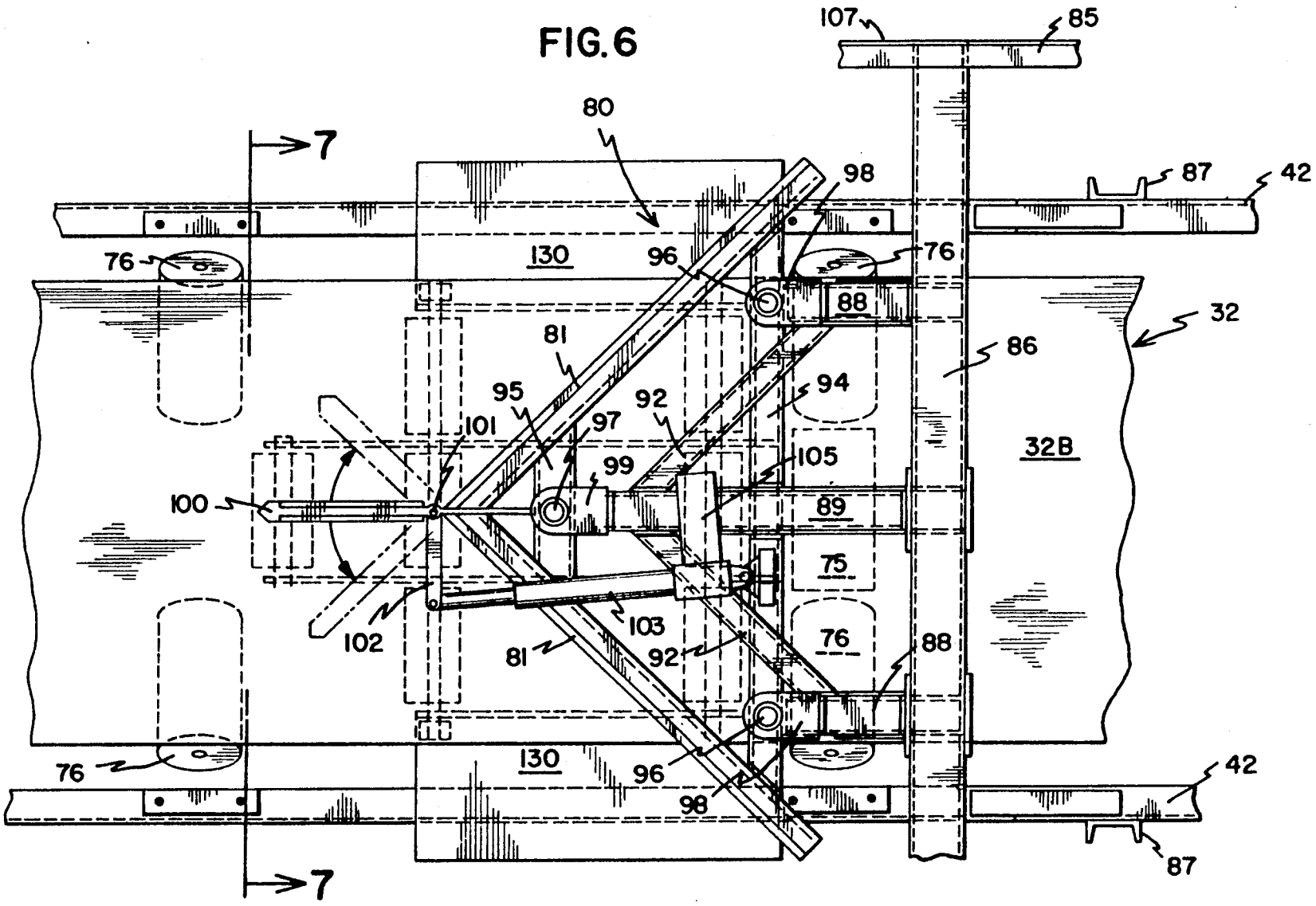
FIG. 6 is an enlarged fragmentary top view of a discharge station and shows the V-plow deflector arrangement for deflecting material carried on the moving endless-betl conveyor off the conveyor on either side thereof when the conveyor belt is raised, thereby discharging material from the conveyor into the hopper or container below.

A deflector plate extension 100 is pivotally mounted to the upstream pointing apex of V-plow 81 by means of pin 101. Deflector plate extension 100 can be pivoted as shown in FIGS. 3 and 6 to one side or the other by means of bellcrank 102 and worm gear actuated telescopic assembly 103, which is attached at one end to bellcrank 102 and at the other end to bracket 104 welded to cross member 94. Electric motor 105 selectively drives a worm gear in opposite directions to extend and retract telescopic assembly 103, to thereby adjust the setting of deflector plate extension 100 throughout the angular range shown in FIGS. 3 and 6 to regulate the deflection of material, M, off the respective sides of conveyor belt 32 as desired, and as explained in greater detail below.

Side curtains 107, shown in FIGS. 1, 3, 6 and 7, extend downwardly from rack 84 near the divergent end of V-plow 81 at each discharge station 33 so that material deflected off the sides of conveyor belt 32 is directed downwardly into the hopper or container 15 below, best seen in FIG. 7.

The belt lifting means 82 for lifting the upper material carrying flight 32B of conveyor belt 32 into close proximity with V-plow 81 to thereby deflect material, M, off the sides of conveyor belt 32 is shown in FIGS. 7 and 8. The vertical sectional view of FIG. 7 is broken to show the lifting means raised on the right and lowered on the left. In FIG. 8 the belt lifting means is shown in its lowered position in solid lines and in its raised position in phantom lines. With reference to FIGS. 3, 7 and 8, conveyor belt lift means 82 is made up of seven lift rollers 110 at each discharge station, which are journaled for rotation on shafts 111 mounted to bars 112, which maintain rollers 110 in a coplaner, parallel relationship as shown in FIGS. 7 and 8. A bearing plate 140 extends across bars 112 and is disposed with its upper surface in the plane of the top surface of rollers 110 to uniformly support upper flight 32B of conveyor belt 32 throughout the surface area of the plate 140.

The linkage for raising and lowering lift rollers 110 is shown in FIGS. 7 and 8 and includes lifting arms 113 keyed to parallel shafts 114, which are in turn mounted for rotation in brackets 115. Brackets 115 are mounted on cross member 48 of conveyor frame 31. Links 116 are also keyed to parallel shafts 114 and are connected by connecting links 118 on each side of conveyor belt 32 by stub shafts 119 of cross members 120. The upstream cross member 120 at each discharge station is provided with clevises 122. The piston end of hydraulic cylinder 123 is pinned to clevis 122 at pin 124. The cylinder end of hydraulic cylinder 123 is pinned at pin 126 to clevis 127, which is welded to a cross member 47 of conveyor frame 31.

A shroud plate 130, shown in FIGS, 6–8, is welded to bars 112 and extends outwardly and downwardly to thereby shield lift means 82 from the falling material, M, deflected off conveyor belt 32.

Actuation of hydraulic cylinder 123 moves actuating links 116 about the axis of shafts 114 from the extended position shown in solid lines in FIG. 8 to the retracted position shown in phantom lines in FIG. 8, thereby pivoting links 113 about the axis of shaft 114 upwardly to lift rollers 110 and the upper flight 32B of conveyor belt 32 into a raised position in close proximity to V-plow 81, as shown in phantom lines in FIG. 8, and vice versa. Hydraulic cylinders 123 can be individually, selectively actuated at the respective discharge stations to raise the material, M, on conveyor belt 32 into engagement with V-plow deflector plates 81 to be deflected off the sides of belt 32 as the belt passes beneath and in close proximity to V-plow deflector plates 81. Selective actuation of hydraulic cylinder 123 provides for discharge of material, M, into the container below at points reasonably spaced throughout the length of the elongated container to achieve a relatively uniform and balanced fitting of the container.

Deflector extension plate 100 may be selectively set to deflect material to the right or left as desired. This adjustment is particularly useful to compensate for tilting of the upper flight 32B of conveyor belt 32 when the conveyor frame 31 and wheeled main frame 12 is tilted to one side or the other when car 11 is on a super-elevated, curved portion of track, and is explained in greater detail below.

Figure 9:
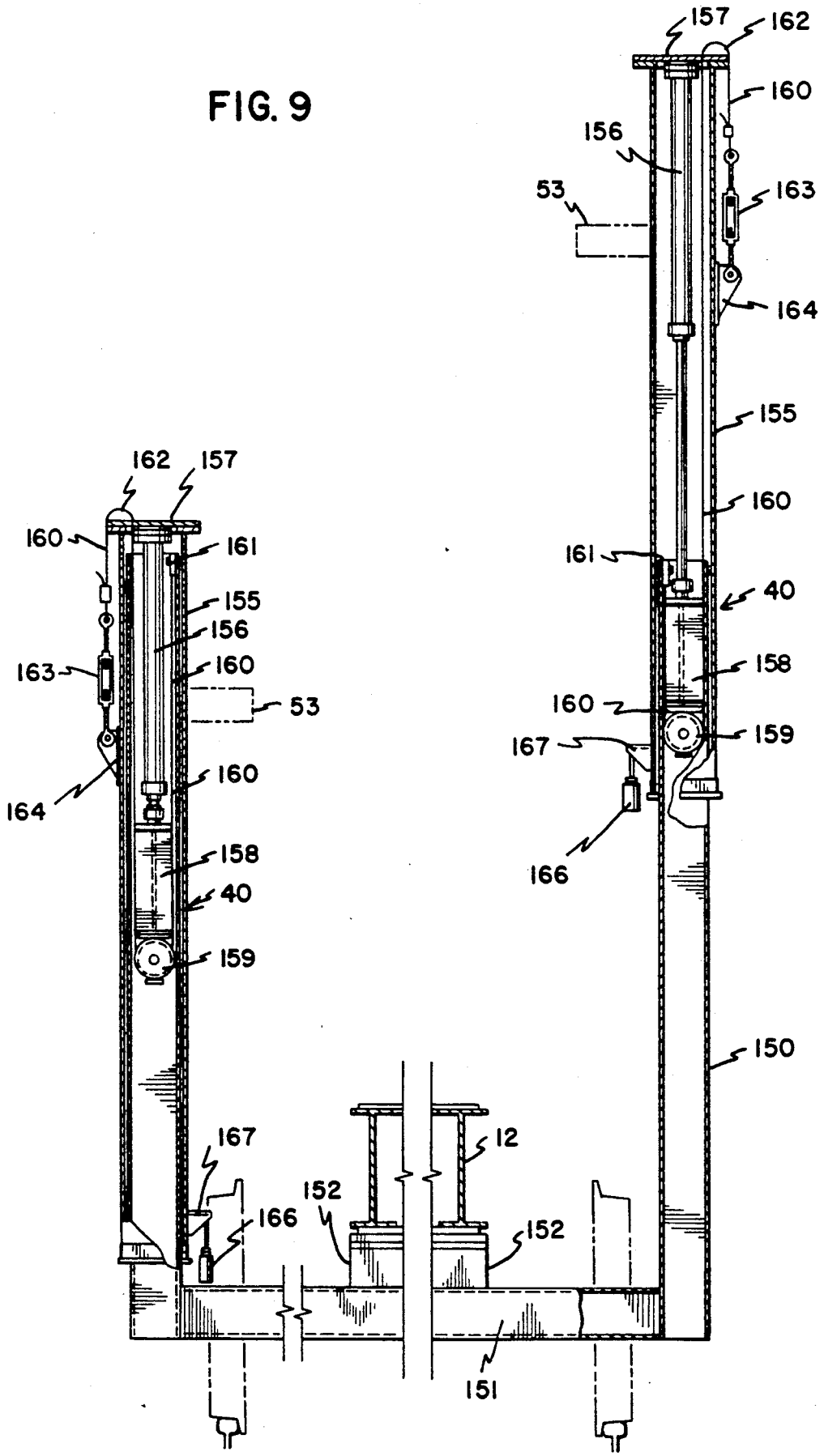
FIG. 9 is a broken end view of a pair of telescopic posts which mount the conveyor frame to the mainframe. For illustration, one post is shown retracted and the other is shown extended. The view is broken in the cneter to indicate that the condition shown represents two positions (extended and retracted) of the pair of posts shown, and not an actual condition. The posts are actually simultaneously extended or retracted together, not separately, as implied in FIG. 9.

Means is provided for raising and lowering the conveyor assembly above the container 15, so the container can be side dumped as shown in FIGS. 13 and 14 without engaging the conveyor assembly, with the conveyor assembly remaining directly on center above the rails during the dumping procedure. The preferred construction for raising and lowering the conveyor assembly is characterized by telescopic corner mounting posts 40, and means for extending and retracting the posts, shown in FIGS. 9, 10 and 12–14. Posts 40 are shown in the retracted position in FIGS. 10 and 12 and in the extended position in FIGS. 13 and 14. In FIG. 9, for illustration only, the left post is in the retracted position and the right is in the extended position. This condition would not occur in actual use.

With reference to FIG. 9, posts 40 are formed with a male section 150 mounted to main frame 12 of railroad car 11 (See also FIG. 11), through cross member 151, gusset plates 152 and bolts 153. Female section 155 is telescopically fitted over male section 150 for extension upwardly and retraction downwardly. Hydraulic cylinder 156 is mounted inside post 40 with its cylinder end fixed to top plate 157 of post 40 and its piston end extending downwardly into male section 150. Mounting block 158 and pulley 159 are mounted to the piston end of hydraulic cylinder 156 as shown to serve to engage cable 160. One end of cable 160 is fixed at clamping block 161 at the upper end of male section 150. Cable 160 extends downwardly through pulley 159 and upwardly to the top of female section 155, out end cap 157, over pulley 162, downwardly to turnbuckle 163, which is fixed to bracket 164 welded to the outside wall of female section 155. A bumper stop 166 is suspended from bracket 167 at the lower end of female section 155 to serve as a stop when female section 155 is fully retracted on male member 150. Stopping occurs with stop 166 engaging main frame cross member 151, as shown at the left in FIG. 9.

The hydraulic cylinder and cable construction described above multiplies by two the effective stroke of hydraulic cylinder 156 in extending female section 150. This can be seen in FIG. 9 by comparing the left and right hydraulic cylinder 156 and their respective effective extension of posts 40 with a given stroke of hydraulic cylinder 156. Extension of hydraulic cylinder 156 a distance, d, extends post 40 a distance, 2d.

Turnbuckle 163 serves as a means for varying the effective length of cable 160 thereby adjusting the elevational position of top plate 157 for a given piston position of hydraulic cylinder 156. Hydraulic cylinders 156 at one end of conveyor assembly 30 are operated simultaneously in the same direction and at the same speed so that end plates 157 at one end remain at the same elevation at all times. Turnbuckles 163 may be used to initially set plates 157 at the same elevation.

Figure 15:
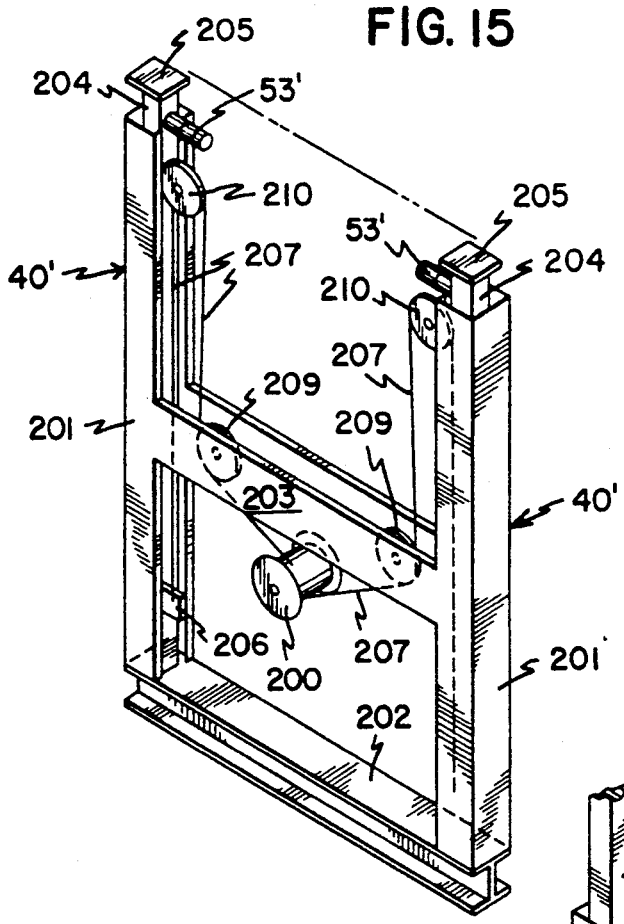
FIG. 15 is a perspective view of an alternate cable and winch design for raising and lowering the pair of telescopic posts which mount the conveyor frame and conveyor to the main frame.
Figure 16:
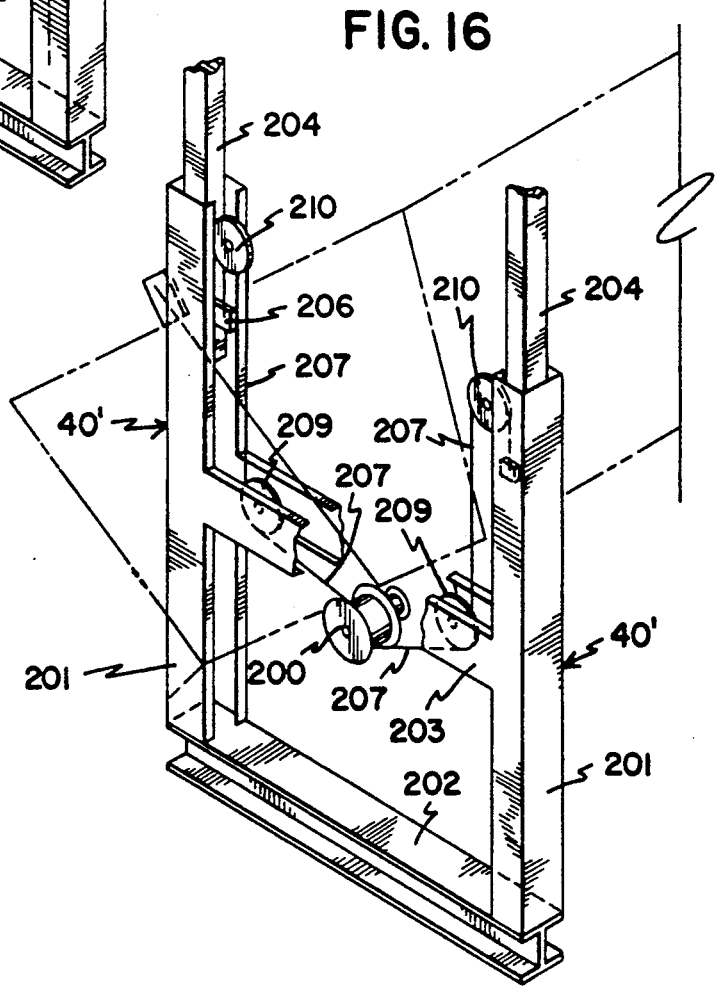
FIG. 16 is a perspective view of the end posts of FIG. 15 with the posts (cut away) in their raised or extended position. The hopper or container is shown in FIG. 16 in phantom in its side dump or discharge position.

An alternate embodiment for raising and lowering posts 40' shown in FIGS. 15 and 16 is characterized by winch 200. Posts 40' are retracted in FIG. 15 and extended in FIG. 16. In this alternate embodiment, posts 40' consist of a lower female section 201 mounted to and extending upwardly from I-beam 202, which is welded to main frame 12. Female sections 201 are connected by cross member 203 and are slotted or open substantially the full length along their inside wall. Male sections 204 are extendable and retractable in female sections 201 and include a top plate 205 and a cable mounting bracket 206. Cables 207 are fixed to and coiled on winch 200 and extend over pulleys 209 mounted inside cross member 203, over pulleys 210 mounted for rotation to the inside wall of posts 40' and then downwardly to cable mounting bracket 206 on the bottom of male sections 204. Simultaneous winding-up and paying-out of cables 207 on winch 200 results in raising and lowering posts 40' simultaneously between the lowered position of FIG. 15 and the raised position of FIG. 16. In the raised position of FIG. 16, the filled hopper or container can be side dumped as indicated.

Operation

The operation of the invention may be understood with reference to FIGS. 2, 6–8, 13 and 14.

Material, M, is dumped into conveyor hopper 34 and, with conveyor motor 77 running on each adjoining car 11, conveyor belt 32 conveys material the length of each belt, and from car to car, as shown in FIG. 2, through each discharge station to the discharge station 33 most distant from the loading point. Hydraulic cylinder 123 at the distant discharge station is actuated and the upper flight 32B of conveyor belt 32 is elevated, as exemplified at discharge station 33B in FIG. 2 and in FIG. 7, to bring belt 32 into close proximity with V-plow deflector 81. Hydraulic cylinder 123 operates on belt 32 through the linkage shown in FIG. 8, resulting in rollers 110 and support plate 140 moving from the lower, solid-line position shown in FIG. 8 to the upper position shown in phantom. Material, M, on belt 32 is deflected off each side of belt 32, as shown in FIG. 7, deflects off of side curtains 107, flows over shrouds 130 and falls into the container below. Discharge of material, M, equally on each side of conveyor belt 32 is preferred and is achieved when car 11 is on level track, when belt 32 is level and deflector plate extension 100 is set pointing straight upstream, as shown in FIGS. 7 and 8.

If, at the time of discharge from a given discharge station, car 11 is parked on a section of super elevated track and belt 32 is not level as shown in FIG. 7, deflector plate extension 100 is moved from the straight upstream position of FIGS. 7 and 8 to a position pointing toward the lower side of belt 32, as shown in FIG. 3, to thereby deflect material, M, from the lower side of belt 32 toward the higher side to achieve a more balanced discharge of material from the respective sides of belt 32. This adjustment compensates for the tendency of material, M, to discharge off the low side of belt 32. It is accomplished by selectively actuating electric motor 105 in one direction or the other, which extends or retracts telescopic arm 103, which operates on link 102 to swing deflector plate extension 100 about the axis of pin 101 to the desired angular setting.

When container 15 is filled in the area beneath the most distant discharge station, hydraulic cylinder 123 is actuated at consecutive discharge stations progressing from the most distant discharge station to the discharge staion nearest the loading point until each car 11 in the train is filled. Each of the cars 11 is then moved to a dumping or discharge point and material, M, is dumped from each car.

The dumping operation is shown in FIGS. 13 and 14. In order to provide clearance for conventional side dumping of container 15 of car 11, the telescopic posts 40 which mount conveyor assembly 30 to main frame 12 are extended by extension of hydraulic cylinders 156 (or, in the case of the embodiment shown in FIGS. 15 and 16, by operation of winch 200) to raise conveyor assembly 30 above container 15 from the lowered position shown in solid lines in FIG. 2, and in FIGS. 10 and 12 to the raised position shown in phantom in FIG. 2 and in FIGS. 13 and 14. It should be noted that conveyor assembly 30 is raised from an inclined lowered position to a level raised position (See FIG. 2), which requires raising the upstream end of conveyor frame 31 more than the downstream end. The pivotal and slidable mounting of conveyor frame 31 to posts 40 at studs 63 and 53 and plates 61 and 51, respectively, allows for this unequal raising of the ends of conveyor frame 31. When conveyor assembly 30 is in the raised position shown in FIGS. 2, 10 and 12, container 15 is side dumped, discharging all material, M, from car 11 in the conventional manner.

It should be noted that throughout the side-dumping operation, conveyor assembly remains centered on car 11 and is not tilted as container 15 is side dumped. This contributes increased stability during side dumping and eliminates the need for tie-downs to prevent the car from tipping.

After car 11 is dumped and container 15 is pivoted back into its load carrying position, conveyor assembly 30 is lowered by retraction of hydraulic cylinders 156 into the inclined position immediately above container 15 as shown in FIG. 2 (solid lines) and in FIGS. 10 and 12. Car 11 is then in condition for reloading in accordance with the operation described above.

Having thus described the invention, the following is claimed.

1. Material handling and transporting apparatus which comprises:

a wheel main frame;

an enlongated container with side and end walls, a bottom and an open top;

menas for mounting said container on the main frame, said mounting means including means for pivotally moving said container on one side or the other with respect to the frame, to thereby provide for side dumping of the container;

a conveyor frame mounted to the main frame and disposed above and in close proximity to the container and extending substantially the length thereof;

an endless belt conveyor with an upper and lower flight mounted on the conveyor frame for conveying material along the conveyor frame;

means for driving the endless belt conveyor;

a plurality of means individually and selectively operable, spaced along the conveyor for deflecting the material carried on the conveyor off a side thereof into the container below; and means mounted on the main frame for raising and lowering the conveyor frame with respect to the main frame and container, to thereby permit pivotal movement of the container for side dumping without engagement between the contaner and the raised conveyor frame.

2. The apparatus of claim 1 wherein the means for deflecting material carried on the conveyor off a side thereof comprises:

a deflector plate mounted on the conveyor frame above the upper flight of the endless belt conveyor, and means mounted on the conveyor frame for lifting the upper flight of the belt upwardly from its normal path into close proximity with the deflector plate, to thereby deflect material on the moving upper flight of the belt conveyor off a side thereof.

3. The apparatus of claim 2 wherein the deflector plate is "V"-shaped and is disposed above the upper flight of the belt conveyor with the "V" pointing in a direction opposing a direction of travel of the upper flight of the belt conveyor, to thereby deflect material on the moving upper flight of the belt conveyor off both sides thereof.

4. The apparatus of claim 3 and a deflector plate extension mounted to the "V"-shaped deflector plate for pivotal movement about a vertical axis in proximity to an apex of the "V"-shaped deflector plate, and means for selectively setting a pivotal position of the deflector plate extension, to thereby vary the material amount deflected off the respective sides of the belt.

5. The apparatus of claim 1 wherein the conveyor frame is mounted to the main frame to permit longitudinal movement of the conveyor frame with respect to the main frame to thereby provide for raising and lowering one end of the conveyor frame more or less than another end.

6. The apparatus of claim 1 wherein the means for raising and lowering the conveyor frame with respect to the main frame and the container comprises:

a pair of vertically disposed telescopic posts with male and female telescopic sections extending from each end of the conveyor frame to the main frame, and means for extending and retracting each pair of posts.

7. The apparatus of claim 6 wherein the means for extending and retracting the posts comprises a hydraulic cylinder mounted in each post.

8. The apparatus of claim 7 including means for multiplying effective stroke of the hydraulic cylinder which comprises a flexible cable fixed at each end to the male and female sections, respectively, and slidably engaging one end of the hydraulic cylinder to thereby provide for telescopic movement of the telescopic posts to a length twice the stroke of the hydraulic cylinder.

9. The apparatus of claim 6 wherein the means for extending and retracting the posts comprises a cable and winch mounted on each pair of telescopic posts and means for simultaneously paying out or taking up the cable on the winch to thereby simultaneously raise and lower the telescopic post of each pair.

10. The apparatus of claim 6 wherein the conveyor frame is mounted to the main frame to permit longitudinal movement of the conveyor frame with respect to the main frame to thereby provide for raising and lowering one end of the conveyor frame more or less than another end.

11. The apparatus of claim 10 wherein the means for deflecting material carried on the conveyor off the side thereof comprises:

a deflector plate mounted on the conveyor frame above the upper flight of the endless belt conveyor, and means mounted on the conveyor frame for lifting the upper flight of the belt conveyor upwardly from a normal path into close proximity with the deflector plate, to thereby deflect material on the moving upper flight of the belt conveyor off a side thereof.

12. The apparatus of claim 11 wherein the deflector plate is "V"-shaped and is disposed above the upper flight of the belt conveyor with the "V" pointing in a direction opposing a direction of travel of the upper flight of the belt conveyor, to thereby deflect material on the moving upper flight of the belt conveyor off both sides thereof.

13. The apparatus of claim 12 including a deflector plate extension mounted to the "V"-shaped deflector plate for pivotal movement about a vertical axis in proximity to an apex of the "V"-shaped deflector plate, and means for selectively setting a pivotal position of the deflector plate extension, to thereby vary the material amount deflected off the respective sides of the belt.

14. The apparatus of claim 13 wherein the means for extending and retracting the posts comprises a hydraulic cylinder mounted in each post.

15. The apparatus of claim 14 including means for multiplying effective stroke fo the hydraulic cylinder which comprises a flexible cable fixed at each end to the male and female sections, respectively, and slidably engaging one end of the hydraulic cylinder to thereby provide for telescopic movement of the telescopic posts to a length twice the stroke of the hydraulic cylinder.

16. The apparatus of claim 6 wherein the means for extending and retracting the posts comprises a cable and winch mounted on each pair of telescopic posts and means for simultaneously paying out or taking up the cable on the winch to thereby simultaneously raise and lower the telescopic post of each pair.

* * * * *

UNITED STATES PATENT AND TRADEMARK OFFICE

CERTIFICATE OF CORRECTION

PATENT NO. : 5,131,798

DATED : July 21, 1992

INVENTOR(S) : James S. Bell and Patrick J. Gallagher

It is certified that error appears in the above-identified patent and that said Letters Patent is hereby corrected as shown below:

Column 1, line 24, delete "unifoirm" and substitute therefor —uniform—.

Column 2, line 1, delete "enedless" and substitute therefor —endless—.

Column 2, line 52, delete "betl" and substitute therefor —belt—.

Column 2, line 57, delete "th e" and substitute therefor —the—.

Column 3, line 65, delete "filed" and substitute therefor —filled—.

Column 4, line 57, delete "thereeby" and substitute therefor —thereby—.

Column 6, line 63, delete "fitting" and substitute therefor —filling—.

Column 9, line 37, delete "menas" and substitute therefor —means—.

Column 11, line 9, delete "the".

UNITED STATES PATENT AND TRADEMARK OFFICE

CERTIFICATE OF CORRECTION

PATENT NO. : 5,131,798

DATED : July 21, 1992

INVENTOR(S) : James S. Bell and Patrick J. Gallagher

It is certified that error appears in the above-indentified patent and that said Letters Patent is hereby corrected as shown below:

Column 12, line 2, delete "fo" and substitute therefor —of—.

Signed and Sealed this

Eighth Day of March, 1994

Bruce Lehman

*Attest:*

BRUCE LEHMAN

*Attesting Officer*

*Commissioner of Patents and Trademarks*